US010427181B2

(12) United States Patent
Rossignol

(10) Patent No.: US 10,427,181 B2
(45) Date of Patent: Oct. 1, 2019

(54) AIR PURGE DEVICE FOR AN AIRLESS LIQUID PRODUCT DISPENSER

(71) Applicant: ALBEA LACROST, Lacrost (FR)

(72) Inventor: Eric Rossignol, Chalon sur Saone (FR)

(73) Assignee: ALBEA LACROST, Lacrost (FR)

( * ) Notice: Subject to any disclaimer, the term of this patent is extended or adjusted under 35 U.S.C. 154(b) by 0 days.

(21) Appl. No.: 15/417,295

(22) Filed: Jan. 27, 2017

(65) Prior Publication Data

US 2017/0216861 A1 Aug. 3, 2017

(30) Foreign Application Priority Data

Feb. 1, 2016 (FR) ..... 16 50785

(51) Int. Cl.
*B05B 11/00* (2006.01)
*B65D 83/00* (2006.01)

(52) U.S. Cl.
CPC ..... *B05B 11/0044* (2018.08); *B05B 11/0041* (2018.08); *B05B 11/0097* (2013.01); *B05B 11/3045* (2013.01); *B05B 11/3047* (2013.01); *B65D 83/0005* (2013.01); *B65D 83/0055* (2013.01); *B65D 2205/04* (2013.01)

(58) Field of Classification Search
CPC ..... B05B 11/0016; B05C 17/00579; B65D 83/0005
USPC ..... 222/387
See application file for complete search history.

(56) References Cited

U.S. PATENT DOCUMENTS 6,598,766 B1 * 7/2003 Brugner ..... B05C 17/00576 222/326
8,919,616 B2 * 12/2014 Obrist ..... B05C 17/00576 222/326
2005/0029306 A1 * 2/2005 Brennan ..... B05C 17/00576 222/327
2005/0066809 A1 * 3/2005 Nehren ..... B05C 17/00576 91/422
2007/0084110 A1 4/2007 Rossignol
2007/0119868 A1 * 5/2007 Kraemer ..... B65D 83/0005 222/256
2008/0083789 A1 * 4/2008 Brugner ..... B05C 17/00576 222/386
2012/0247323 A1 * 10/2012 Obrist ..... B05B 11/02 92/175

FOREIGN PATENT DOCUMENTS

EP 1514812 A1 3/2005
EP 2133153 A1 12/2009
FR 2926798 A1 7/2009
WO 2005113379 A1 12/2005

OTHER PUBLICATIONS

Oct. 12, 2016—(FR) Search Report—App 1650785.

* cited by examiner

*Primary Examiner* — Jeremy Carroll
(74) *Attorney, Agent, or Firm* — Banner & Witcoff, Ltd.

(57) ABSTRACT

Air purge device for an airless liquid product dispenser having a container equipped with means for sampling the product. The device has a bleed ring that has a deformable lip seal accommodated inside a protective part designed to be inserted into the container. The deformation of the lip when mounting the air purge device in the container causes the air to be purged from the container.

15 Claims, 8 Drawing Sheets

AIR PURGE DEVICE FOR AN AIRLESS LIQUID PRODUCT DISPENSER

CROSS-REFERENCE TO RELATED APPLICATIONS

This application claims priority to French application serial No. 1650785 filed Feb. 1, 2016 which application is hereby incorporated by reference in its entirety.

FIELD OF THE INVENTION

The invention relates to an air purge device for an airless liquid product dispenser. The invention further relates to a dispensing head for such a dispenser, as well as to a plugging device for such a dispenser. Finally, the invention relates to an airless liquid product dispenser comprising such a dispensing head and such a plugging device.

More specifically, the invention is applicable to the dispensing of cosmetic or pharmaceutical products from a container particularly equipped with means for sampling the product.

It can be a rigid or flexible container. As the consumer samples the product, either a negative pressure develops in the container and the sampling system must overcome this negative pressure in order to continue to operate correctly or the internal volume of the container decreases, either by deforming, if the container is flexible, or, if the container is rigid, by virtue of a movable base provided with sealing means, via a piston, for example, in order to compensate for the vacuum thus created.

When assembling the dispenser, residual air can be present in the container. This residual air can disrupt the use of the product, namely incomplete dosages, sputtering when dispensing, alteration of the chemical properties of the product, etc.

BACKGROUND

Dispensing heads are known that comprise a flexible bleed ring that allows the function for purging the residual air present in the container to be provided. However, this flexible ring is relatively fragile, particularly at its peripheral lip seal, and can be damaged when it is bulk packaged or when it is distributed on the packaging lines, whether or not it is assembled in the dispensing head. Indeed, even when it is assembled in the dispensing head, the ring projects from the dispensing head and its entire peripheral edge, including the lip, is exposed, resulting in the risk of damage. However, the airtightness of the dispenser and the correct internal packaging of the product are closely dependent on the reliability of the ring.

SUMMARY OF THE INVENTION

An object of the present invention is to overcome the various aforementioned disadvantages by means of a device that allows the residual air present in the container to be purged, whilst protecting the bleed ring from the moment it leaves the mould and until it is mounted in the container, in order to prevent any risk of subsequent leaks.

This object is achieved by virtue of an air purge device for an airless liquid product dispenser comprising a container equipped with means for sampling the product, said device comprising a bleed ring that comprises a deformable lip seal accommodated inside a protective part designed to be inserted into the container, the deformation of the lip when mounting the air purge device in the container causing the air to be purged from the container.

The main idea of this invention consists in systematically associating a protective part intended to protect the bleed ring, from its time of manufacture and until it is mounted in the dispenser. The purpose of the bleed ring is to purge the residual air present in the container when assembling the dispenser. The bleed ring is only activated when assembling the dispenser so that it can be placed into service devoid of return air. The bleed ring is no longer used once the dispenser is placed into service and delivers doses of product. The absence of air in the container is then guaranteed either by the deformation of the container or by a movable piston.

According to the various embodiments of the invention, which can be taken in combination or individually:

- the bleed ring is provided with retention and wedging means cooperating with the protective part;
- the retention and wedging means consist in a socket cooperating with a central sleeve extending from the protective part;
- the axial socket of the bleed ring is inserted into the central sleeve of the protective part;
- the central sleeve of the protective part is inserted into the axial socket of the bleed ring;
- the bleed ring is formed by a cap that is annularly extended by said lip seal;
- said lip seal connects to the edge of the cap via a concave portion and presses against an internal wall of the protective part by buttressing;
- said protective part is made up of a disc provided with a central opening, from which a central sleeve extends, and a peripheral skirt seal connected to the external edge of the disc, the peripheral lip seal of the bleed ring coming to bear against the wall of the central sleeve or against the wall of said peripheral skirt seal of the protective part;
- the disc of the protective part has a circular section;
- the disc of the protective part has an oval section.

According to a first possible configuration, the protective part consists in a neck belonging to a dispensing head of the product dispenser.

According to a second possible configuration, the protective part consists in a piston belonging to the product dispenser.

According to the first configuration, the invention further relates to a dispensing head for an airless liquid product dispenser, comprising a pump and an air purge device as previously described, the protective part consisting in a neck clipped onto the pump, said retention and wedging means of the bleed ring consisting in an axial socket inserted and wedged into the central sleeve of the neck.

More generally, the invention relates to an airless liquid product dispenser comprising a container, as well as a dispensing head as previously described, the lip of the bleed ring being elastically deformed by overpressure when assembling the dispensing head on the container. The purging of the residual air that exists inside the dispenser during its assembly is then carried out via the dispensing head.

According to the second configuration, the invention further relates to a plugging device for an airless liquid product dispenser comprising a container equipped with means for sampling the product, said device comprising a base part forming the base of the dispenser and being equipped with an air purge device as previously described, the protective part consisting in a piston mounted on the base part.

According to the various embodiments of the invention, which can be taken in combination or individually:

- the base part is made up of a base forming the base of the dispenser, as well as a peripheral section designed to surround the container;
- the air purge device is translationally movable relative to the base part between an initial extended position, from the moment it is packaged and until the plugging device is installed in the dispenser, and a final retracted position before the product is dispensed, the transition from the extended position to the retracted position causing the air to be purged from the dispenser by the deformation of the lip of the bleed ring;
- said retention and wedging means of the bleed ring consist in an axial socket inserted and wedged into the central sleeve of the piston, the ring being movable relative to the piston between an initial extended position, in which the axial socket projects outwards from the base part, and a final retracted position, in which the axial socket is located inside the base part, the transition from the extended position to the retracted position causing the air to be purged from the dispenser by the deformation of the lip of the bleed ring;
- the piston comprises a first central sleeve extending from an upper face of the disc and cooperating with the bleed ring and a second central sleeve extending from a lower face of the disc towards the base of the container and being designed to be introduced into a central opening provided in the base part to this end;
- the ring is fixed relative to the piston, the piston being movable between an initial extended position, in which the second central sleeve projects outwards from the base part, and a final retracted position, in which the second central sleeve is located inside the base part, the transition from the extended position to the retracted position causing the air to be purged from the dispenser by the deformation of the lip of the bleed ring;
- the free end of the skirt of the piston wedges against the internal wall of the container in order to make the dispenser airtight when it is used.

More generally, the invention relates to an airless liquid product dispenser comprising a container equipped with means for sampling the product, as well as a plugging device as previously described. The purging of the residual air that exists inside the dispenser during its assembly is then carried out via the plugging device.

BRIEF DESCRIPTION OF THE DRAWINGS

The invention will be better understood, and further objects, details, features and advantages thereof will become more clearly apparent, throughout the following detailed description of at least one embodiment of the invention, which is provided by way of a purely illustrative and non-limiting example, with reference to the accompanying schematic drawings, in which.

DETAILED DESCRIPTION OF EXEMPLARY EMBODIMENTS

The air purge devices shown in the various FIGS. are intended to be mounted on dispensers of liquid or semi-liquid products 7 operating airlessly and which are sometimes called "airless" dispensers.

This type of dispenser is particularly equipped with a container 6 and means for sampling the product 7, such as a pump 5.

Figure 1:
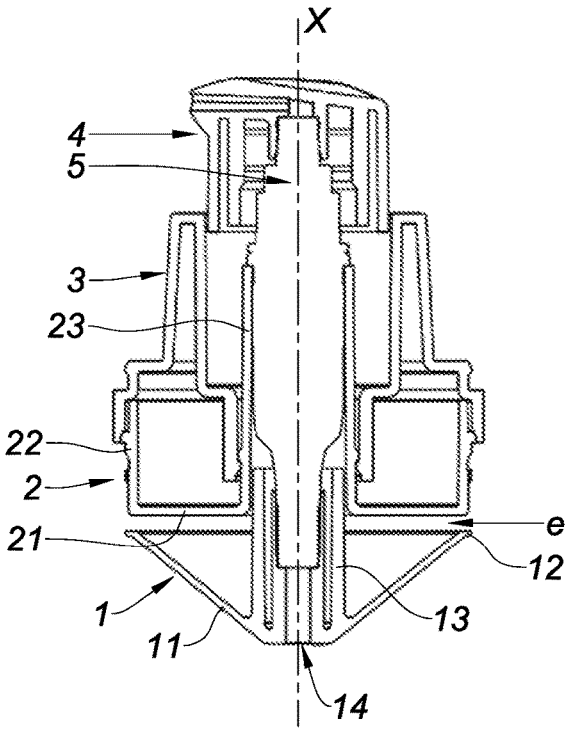
Fig. 1 PRIOR ART
FIG. 1 shows a section view of a dispensing head provided with an air purge device according to the prior art.

FIG. 1 shows a dispensing head according to the prior art conventionally comprising the following elements:

- a pushbutton 4;
- a pump 5 bringing the product from a container (not shown) to the pushbutton 4;
- a neck 2 mounted on the pump 5;
- a finishing collar 3 mounted on the neck 2 and allowing the pump 5 to be concealed.

In this case, the container can consist in a flexible container of the bag or tube type or a rigid container of the bottle type. This container may or may not contain a piston or any other system allowing the dispenser to operate airlessly.

Such a dispensing head can include residual air as it is assembled onto the container during the packaging operation. This residual air can hinder the use of the product to be dispensed.

For this reason, a flexible bleed ring 1 is added to the dispensing head and allows the air purge function to be provided.

This bleed ring 1 is fixed to the neck 2 of the dispensing head.

More specifically, it consists in a cap 11 with a truncated aspect, extended laterally outwards by a lip seal 12, directed perpendicular to the central axis X of the ring 1. This lip 12 is generally made from a flexible material, for example a low-density polyethylene, or is elastomer-based, and is fragile, particularly at its thin end, which is intended to come into abutment, under a slight stress, against the internal wall of the container.

The bleed ring 1 further comprises an axial socket 13 centred on the cap 11. This socket 13 is provided with retention means for fixing it to the pump 5. The socket 13 is hollow and has a through opening 14 so that the product contained in the container can pass through the socket 13, then into the pump 5 in order to be brought to the pushbutton 4.

The ring 1 is thus fixed to the pump 5 and projects from the lower part of the dispensing head. The lip 12 is separated from the neck 2 by a gap e. The lip 12 is thus exposed, without any protection surrounding it, and can be damaged during the bulk storage of the dispensing heads thus equipped with rings 1.

Figure 2:
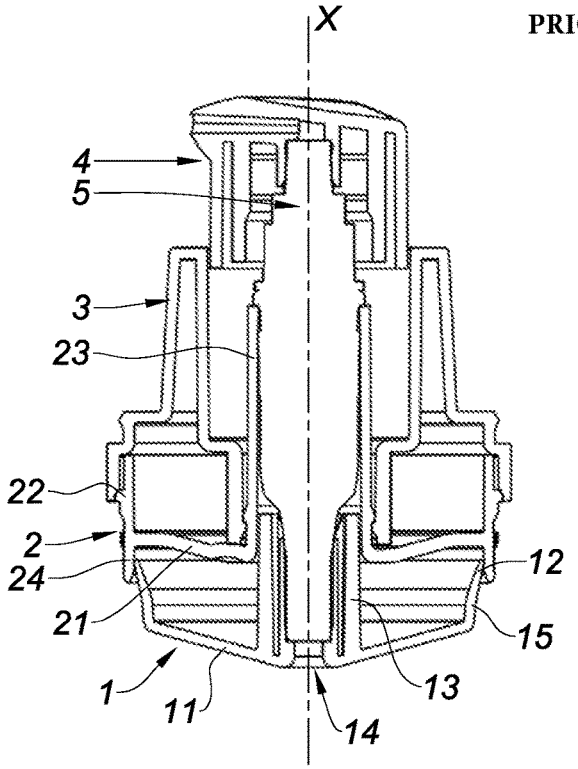
FIG. 2 shows a section view of a dispensing head provided with an air purge device according to a first possible configuration of the invention.

FIG. 2 shows a dispensing head according to the invention. It is similar to that of FIG. 1 with respect to the elements that use the same reference numeral, with the exception of the neck 2 and the bleed ring 1, which together form a first possible configuration of the air purge device according to the invention.

Indeed, the neck 2 is now provided with a peripheral skirt 24 extending towards the ring 1 in order to protect its lip 12.

More specifically, the neck 2 conventionally comprises a disc 21, of circular or oval section, for example, provided with a central opening, from which a central sleeve 23 extends, into which the lower part of the pump 5 is inserted. This neck 2 further conventionally comprises an annular return 22 directed towards the pushbutton 4 and allowing the centring and wedging of the finishing collar 3. In addition to this return, and as previously mentioned, the neck 2 comprises, according to the invention, a peripheral skirt 24 connected to the edge of the disc 21 and extending in a direction opposite the annular return 22. The lip 12 of the ring 1 comes into abutment against the internal wall of this peripheral skirt 24.

As is the case in the embodiment shown in FIG. 1, the airtightness between the dispensing head and the container is not provided by the ring 1 but is provided by the peripheral skirt 24 of the neck 2. This skirt 24 thus comes into sealed abutment against the internal wall of the container.

The ring 1, however, still comprises a cap 11 with a truncated aspect, but with a clearly more obtuse angle, allowing a significant reduction in the height of the ring 1. Thus, the spatial requirement of the ring 1 is reduced compared to the prior art, which allows more compact dispensers to be manufactured for an equivalent volume of product. The cap 11 also can be hemispherical.

The lip seal 12 is directed parallel to the central axis X of the ring 1. This lip 12 connects to the edge of the cap 11 via a concave portion 15. The lip 12 comes into contact with the internal wall of the peripheral skirt 24 of the neck 2 by buttressing. The lip 12 of the bleed ring 1 is thus accommodated in the skirt 24 of the neck 2. This lip 12 is thus protected in the event of bulk packaging of the dispensing heads and their seal can be checked before assembly on the container. The neck 2 thus acts as a protective part for the ring 1.

Figure 3:
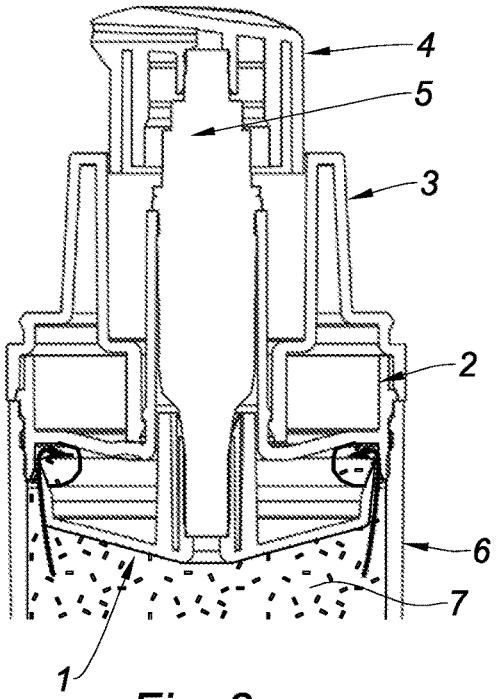
FIG. 3 shows the dispensing head according to FIG. 2 assembled on a container.

The operation of this dispensing head is shown in FIG. 3. When the head is pushed onto the container 6 during packaging (i.e. when assembling the dispenser), the skirt seal 24 of the neck 2 accommodates into the container 6. Lowering this head into the product 7 causes a slight overpressure in the container 6, which elastically deforms the lip 12 of the bleed ring 1 so that the residual air present in the container 6 can pass between the skirt 24 of the neck 2 and the lip 12 of the ring 1 in order to escape from the container 6. This air is then contained in a space provided to this end between the ring 1 and the neck 2. A slight overflow of the liquid product 7 in this same space, after having expelled the air over the top of the flexible lip 12, allows the assembly to be fully purged.

This container 6 can be flexible or rigid and may or may not contain a piston 8 (or another system) for following the variability of the volume of product 7.

Figure 4:
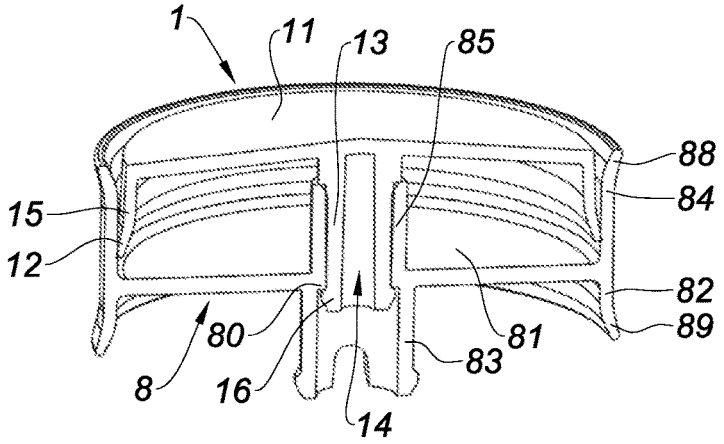
FIG. 4 shows a section and perspective view of an air purge device according to a second possible configuration of the invention.

FIG. 4 shows a second possible configuration of the air purge device according to the invention. It is still made up of a bleed ring 1 and a protective part, in this case consisting in a piston 8. This device is no longer intended to be disposed on a dispensing head, and thus on the upper part of a dispenser, but in the base of the container 6 of the dispenser, and thus in the lower part of a dispenser. The piston 8 moves from the bottom to the top of the container 6 in order to reduce the internal volume of the container 6 as and when the consumer samples the product 7. It provides the static and dynamic seal with the internal wall of the container 6 through a sliding movement.

The ring 1 is identical to that described with reference to FIGS. 2 and 3, except with respect to the axial socket 13. This socket 13 still comprises a central opening 14, but by contrast it no longer opens out at the cap 11, since the ring 1 must provide the seal for the container 6 with the piston 8 when said piston progressively rises as the dispenser is used. The ring 1 and the piston 8 therefore must have a completely sealed surface relative to the container 6. Therefore, the cap 11 of the ring 1 is solid, without openings.

The socket 13 has an end piece 16 at its free end that allows it to be fitted into the sleeve of the piston 8 by elastic deformation.

The piston 8, however, comprises a disc 81, of circular or oval section, for example, in order to be adapted to the section of the container 6. This disc 81 is provided with a central opening, from which two sleeves 83, 85 extend.

A first sleeve 85 extends from the upper surface of the disc 81 towards the ring 1 and accommodates the socket 13 of the ring 1. A second sleeve 83 extends from the lower surface of the disc 81 towards the base of the container 6 when the piston 8 is raised in the container 6. The opening opens out into the two sleeves 83, 85. The diameter of the first sleeve 85 is less than the diameter of the second sleeve 83. Therefore, there is a shoulder 80 at the junction between the two sleeves 83, 85. The end piece 16 of the socket 13 of the ring 1 is retained by this shoulder 80 after it is snapped into the second sleeve 83 of the piston 8.

The piston 8 further comprises a first peripheral skirt 84 connected to the external edge of the disk 81 and extending towards the ring 1. The lip 12 of the ring 1 comes into abutment against the internal wall of this first peripheral skirt 84. The lip 12 is thus protected in the piston 8.

Figure 5A:
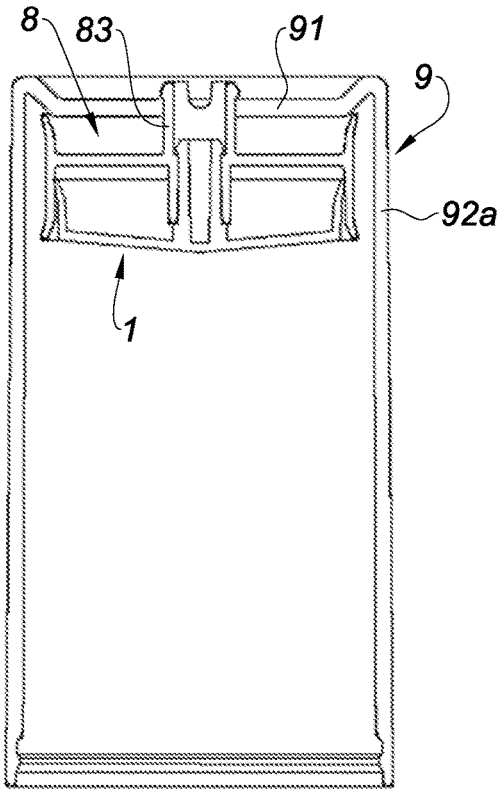
FIGS. 5*a* and 5*b* show section views of two variants of a plugging device provided with a purge device according to FIG. 4.
Figure 5B:
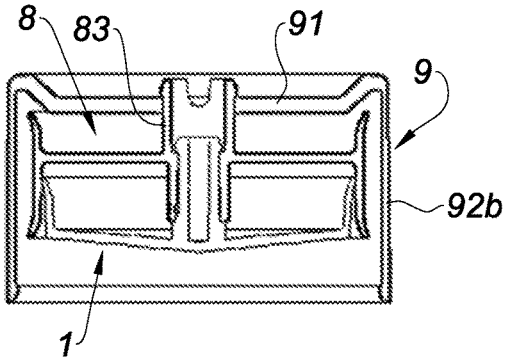

The piston 8 comprises a second peripheral skirt 82 connected to the external edge of the disk 81 and extending towards the base of the container 6 when the piston 8 is mounted in the container 6. The free ends of the two skirts 82, 84 consist in lip seals 89, 88, the purpose of which is to provide the seal for the container 6 when the dispenser is used. These lips 89, 88 are also fragile, as is the lip 12 of the ring 1. In order to protect them when they are stored, the bleed ring 1 and piston 8 assembly is fixed into a base part 9, which will be stored in bulk and then packaged. This base part 9 protects the lips 89, 88 of the piston 8, as can be seen in FIGS. 5*a* and 5*b*. The base part 9, bleed ring 1 and piston 8 assembly is called a plugging device as it allows a base-less container 6 to be plugged. It is this type of container 6 that will be used to accommodate the bleed ring 1 and piston 8 assembly according to the invention.

In FIGS. 5*a* and 5*b*, the plugging device is inverted, since the dispenser is assembled with the head facing downwards in order to be able to pour the product 7 into the container 6 through its open base.

The base part 9 comprises:

- a base 91 provided with a central opening, into which the second sleeve 83 of the piston 8 is fitted; this base 91 forms the base of the container 6 and thus of the dispenser;
- a peripheral section 92; this section is long 92*a* in FIG. 5*a* (variant a) and short 92*b* in FIG. 5*b* (variant b).

Figures 6A, 6B:
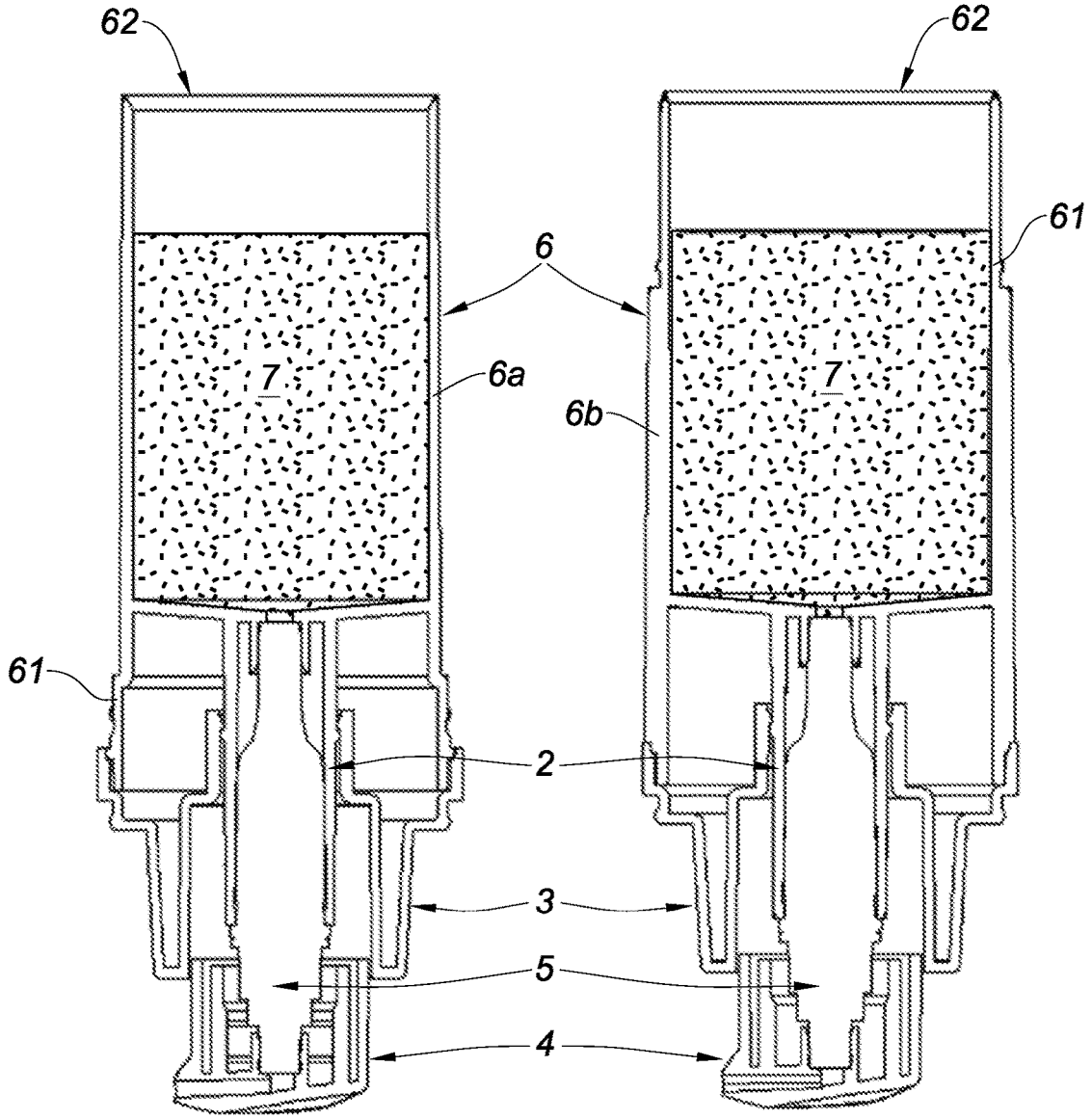
FIGS. 6*a* and 6*b* show section views of two variants of a container assembled on a dispensing head, corresponding to FIGS. 5*a* and 5*b;*

This base part 9 corporates with a container 6 equipped with a dispensing head, as shown in FIGS. 6*a* and 6*b*.

The container 6 in FIG. 6*a* (variant a) comprises a fitting zone 61 located at a distance from its open end 62 so that the long section 92*a* of the base part 9 according to FIG. 5*a* can be fitted therein.

The container 6 in FIG. 6*b* (variant b) comprises a fitting zone 61 located relatively close to its open end 62 so that the short section 92*b* of the base part 9 according to FIG. 5*b* can be fitted therein.

It is thus possible for the length of the peripheral section 92 of the base part 9 to be varied as a function of the location of the fitting zone 61 on the container 6, and vice versa.

The operation of the plugging device according to the two variants a and b will now be described.

FIGS. 6*a* and 6*b*: the product 7 to be packaged is poured into the container 6, as shown in FIGS. 6*a* and 6*b*.

Figures 7A, 7B:
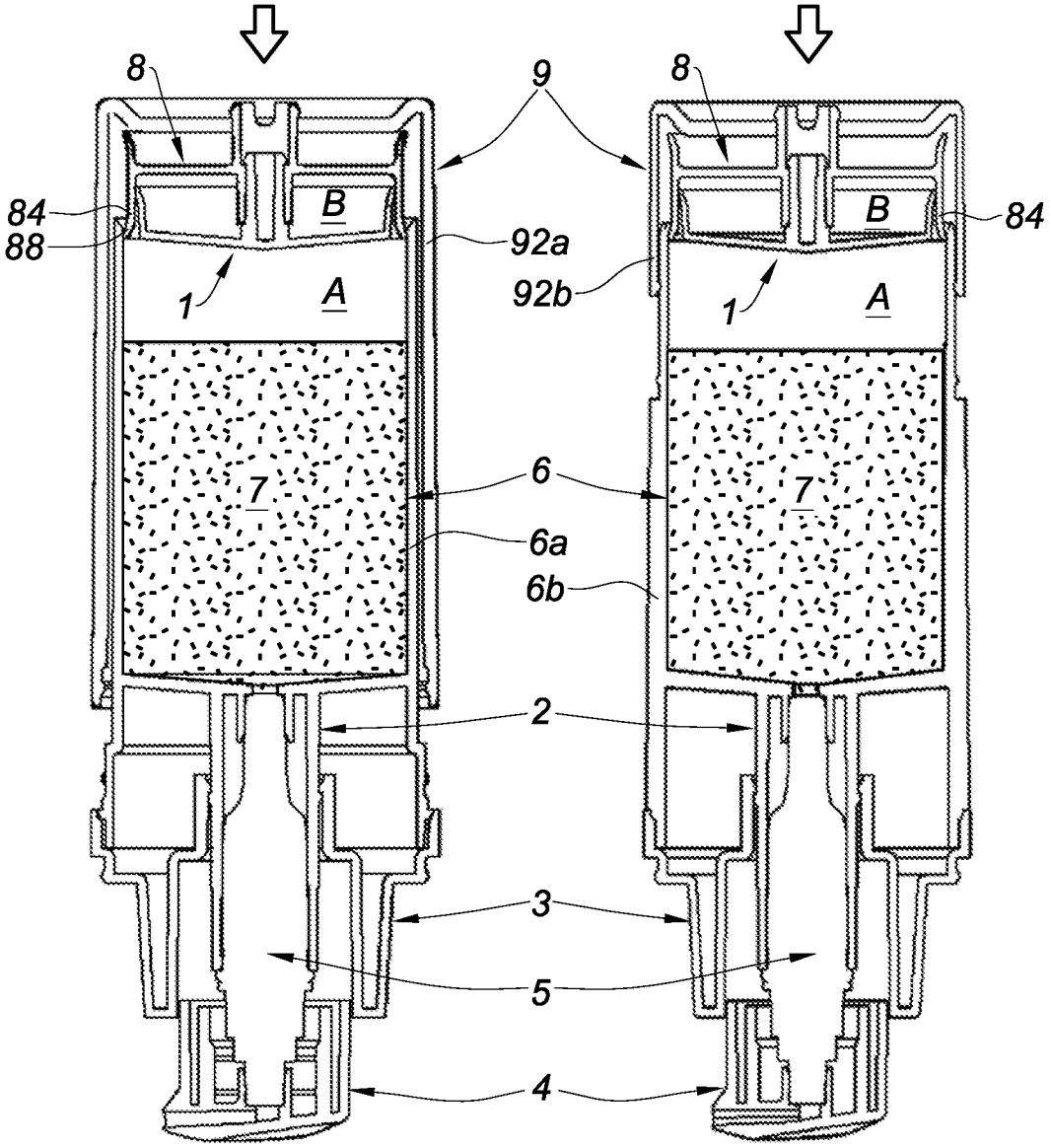
FIGS. 7*a* and 7*b*, 8*a* and 8*b*, 9*a* and 9*b* show the steps of assembling a plugging device according to FIGS. 5*a* and 5*b* onto a container according to FIGS. 6*a* and 6*b;*

FIGS. 7*a* and 7*b*: the base part 9 is then positioned above the container 6 and centred on the container 6 so that the lip 88 of the first skirt 84 of the piston 8 comes into contact with the internal wall of the container 6 so as to seal the container. As the base part 9 approaches the container 6, the air pressure contained in the volume A increases. This volume A corresponds to the volume of air inside the container 6 between the product 7 and the ring 1.

Figures 8A, 8B:
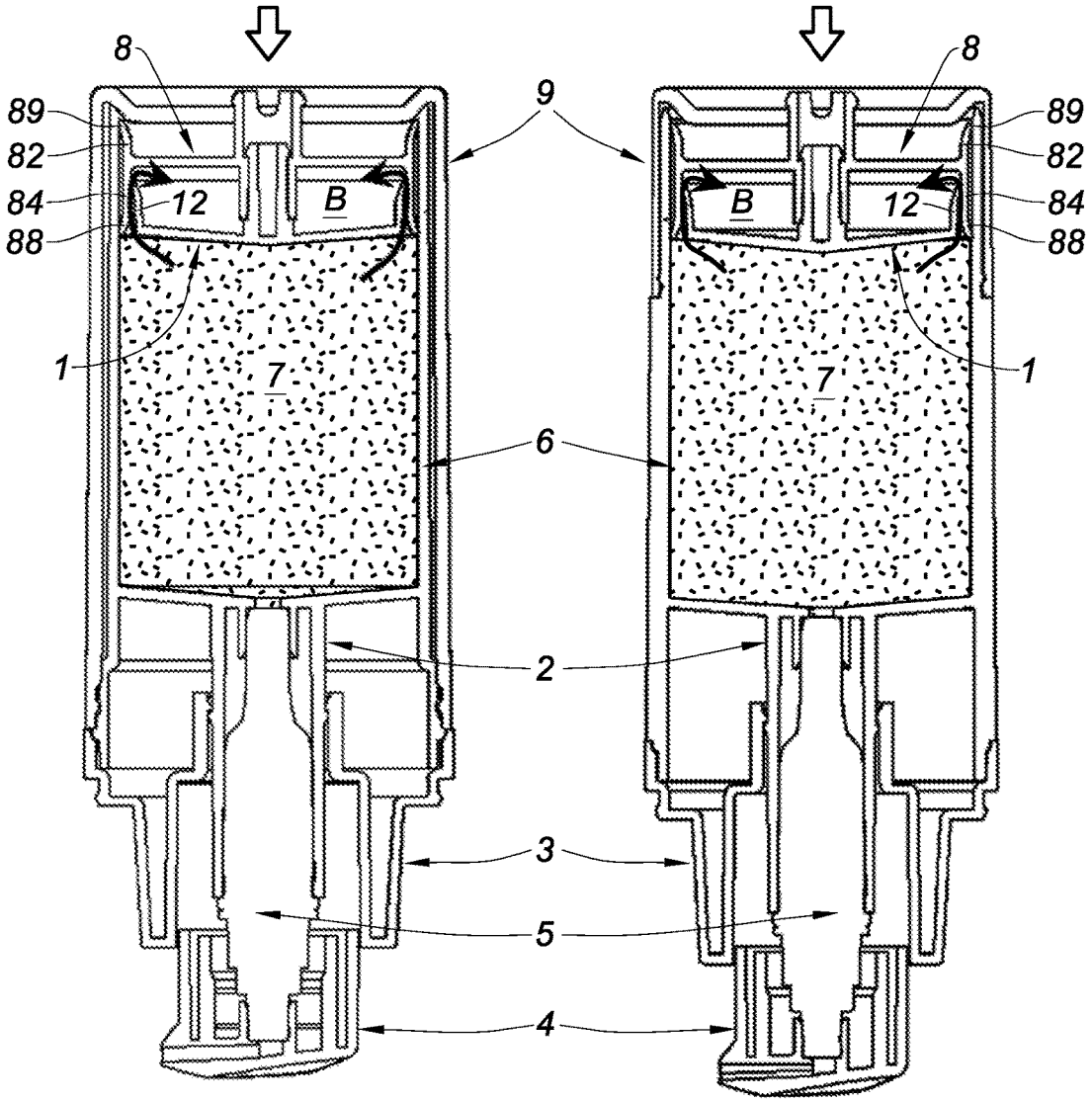

FIGS. 8*a* and 8*b*: the base part 9 continues its approach until it is flush with the container 6. The lip 89 of the second skirt 82 of the piston 8 finally comes into contact with the internal wall of the container 6 so as to complete the seal. The volume of air A is expelled into the chamber B by elastically deforming the lip 12 of the bleed ring 1. The chamber B corresponds to the space that is defined between the ring 1 and the piston 8.

Figures 9A, 9B:
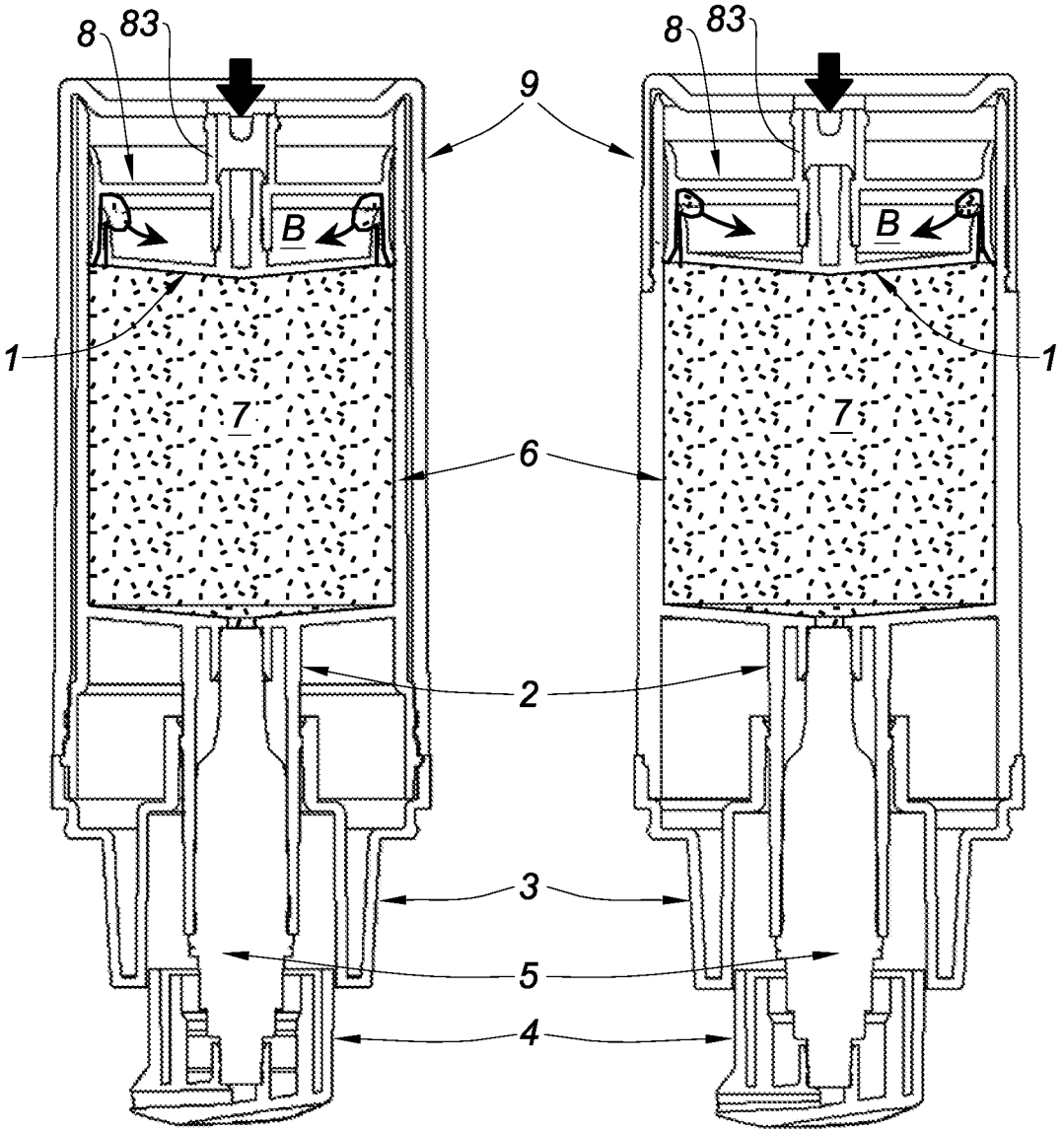

FIGS. 9*a* and 9*b*: by pressing the second sleeve 83 of the piston 8 projecting from the base part 9 so as to fully retract the piston 8 into the container 6, the remainder of the volume of air A is expelled into the chamber B by the deformation of the lip 12 of the bleed ring 1. A small volume of product 7 is also expelled into the chamber B to ensure a complete purge. The dispenser is then packaged without residual air and can be repositioned the right way up. The piston 8 (and the ring 1 that is fixed thereto) can then progressively move towards the dispensing head as and when the product 7 is dispensed.

The piston 8 thus can be moved relative to the base part 9 between an initial extended position, shown in FIGS. 5*a* to 8*b*, and a final retracted position, shown in FIGS. 9*a* to 9*b*. The ring 1 remains fixed relative to the piston 8.

Figure 10:
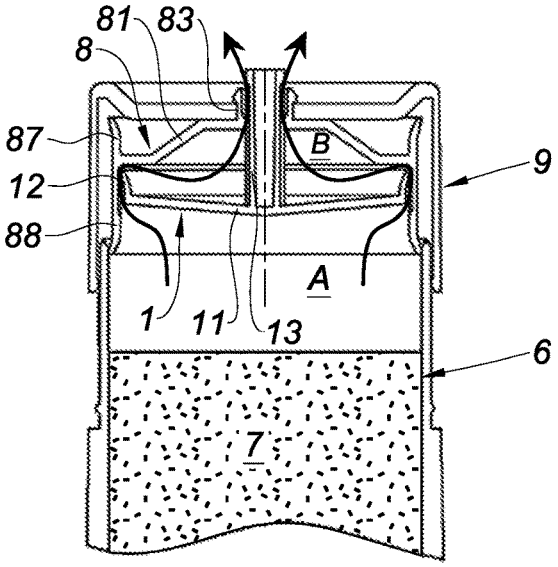
FIGS. 10, 11 and 12 show the steps of assembling a plugging device provided with a purge device according to a third possible configuration of the invention onto a container according to FIGS. 6*a* and 6*b;*
Figure 11:
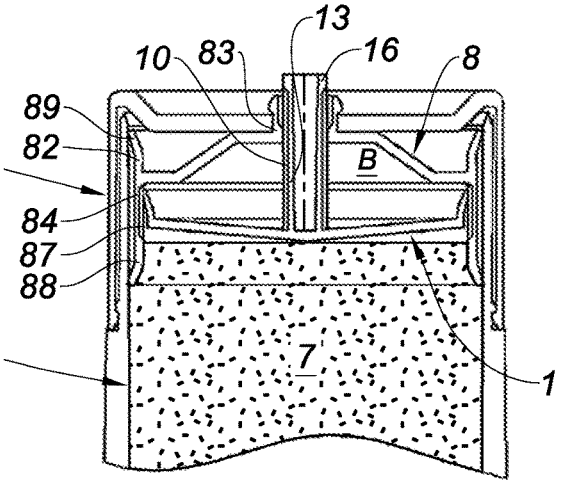
Figure 12:
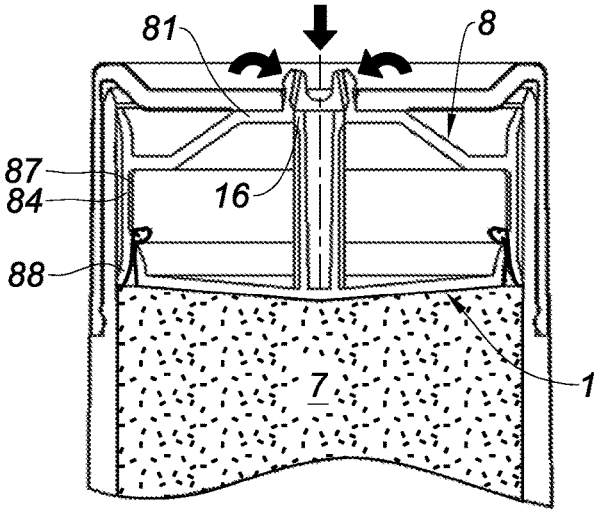

FIGS. 10 to 12 show a third possible configuration of the purge device. The base part 9, the piston 8 and the ring 1 are identical to the parts described with reference to FIGS. 5*a* to 9*b* (two variants are still possible), apart from a few details, as will be explained hereafter.

The first skirt 84 of the piston 8 comprises ribs 87 provided in the internal wall of the skirt 84 at a height beginning at the junction with the disc 81 and ending before the beginning of the lip 88 of the skirt 84. This grooved zone 87 thus does not extend at the lip 88 of the first skirt 84.

The piston 8 comprises a single sleeve 83 extending towards the base part 9 and being inserted into the opening of the base part 9.

The bleed ring 1 comprises an extended axial socket 13 designed to be inserted into the sleeve 83 of the piston 8. This socket 13 further comprises a grooved zone 10 extending over its entire length, except at its end piece 16.

The bleed ring 1 is translationally movable relative to the piston 8 between:

a. an extended position, in which the socket 13 completely passes through the sleeve of the piston 8 until it is projecting. In this position, the lip 12 of the bleed ring 1 comes into contact with the grooved zone 87 of the first skirt 84 of the piston 8. By virtue of the grooved zones 87 and 10, an air flow thus can circulate between the lip 12 of the ring 1 and the first skirt 84 of the piston 8, as well as between the socket 13 of the ring 1 and the sleeve 83 of the piston 8. The residual air thus can escape towards the outside;

b. a retracted position, in which the end piece 16 of the socket 13 of the ring 1 is no longer inserted in the sleeve 83 of the piston 8, but is located at the edge of the opening made in the disc 81. This end piece 16 has an external diameter that is slightly larger than that of the socket 13 and thus comes into sealed abutment against the disc 81 of the piston 8. Therefore, an air flow can no longer circulate between the socket 13 and the sleeve 83.

In FIG. 10, the base part 9 is positioned above the container 6 and is centred on the container 6 so that the lip 88 of the first skirt 84 of the piston 8 comes into contact with the internal wall of the container 6 so as to seal the container. The ring 1 is in the extended position. As and when the base part 9 approaches the container 6, the air pressure contained in the volume A does not increase and passes directly into the chamber B via said ribs 87 provided in the first skirt 84 of the piston 8, then escapes towards the outside by passing between the socket 13 and the sleeve 83, as shown by the arrows.

In FIG. 11, the base part 9 continues its approach until it is flush with the container 6. The lip 89 of the second skirt 82 of the piston 8 finally comes into contact with the internal wall of the container 6 so as to complete the seal. The volume of air A is still expelled into the chamber B via the ribs 87 provided in the skirt 84 of the piston, then escapes towards the outside via the ribs 10 provided in the socket 13 of the ring 1.

In FIG. 12, following a manual pressure exerted on the end piece 16 of the socket 13 of the ring 1, said ring moves to the retracted position. The remainder of the volume of air A is expelled through the advance of the bleed ring 1 within the container 6. A small volume of product 7 is also expelled into the chamber B to ensure a complete purge by the elastic deformation of the lip 12 of the bleed ring 1. The relative movement between the socket 13 of the bleed ring 1 and the sleeve 83 of the piston 8 shuts off the air from escaping towards the outside and the lip 12 of the ring 1 leaves the grooved zone 87 of the skirt 84 of the piston 8. The dispenser is then packaged without residual air.

As the sleeve 83 of the piston 8 is thus released from the socket 13 of the ring 1, it constricts in order to be released from the base part 9. To this end, the sleeve 83 is naturally curved when it does not undergo any stress. The piston 8 is then free to translationally move relative to the container 6 in order to control the internal volume of the container 6 according to the amount of product 7 sampled by the consumer.

In this configuration, the purge is thus carried out without overpressure, which allows the purge to be optimised.

Figure 13:
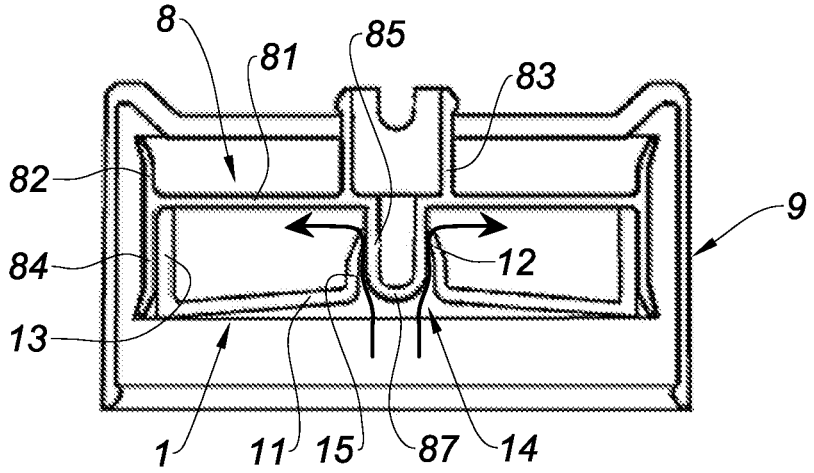
FIG. 13 shows a section view showing a plugging device provided with a purge device according to a fourth possible configuration of the invention.

FIG. 13 shows a fourth possible configuration of a purge device equipping a plugging device. The base part 9, the piston 8 and the ring 1 are identical to the parts described with reference to FIGS. 5*a* to 9*b* (two variants are still possible), apart from a few details, as will be explained hereafter.

The piston 8 still comprises a twin sleeve 83, 85, but the free end 87 of the first sleeve 85 is now closed. Consequently, the central opening only opens out at the side of the second sleeve 83.

With respect to the bleed ring 1, the socket 13 and the lip 12 are now reversed, i.e. positioned in place of one another.

More specifically, the socket 13 extends from the external edge of the cap 11 towards the piston 8, whereas the lip 12 extends from the edge of the internal opening 14 of the cap 11 towards the piston 8. The lip 12 still comes into contact with an internal wall of the piston 8, but it now involves the wall of the first sleeve 85. The lip 12 surrounds the first sleeve 85 and comes into contact with the wall of the sleeve 85. The socket 13 comes into contact with the internal wall of the first skirt 84 of the piston 8 in a sealed manner In this configuration, the volume of air in A is still expelled into the chamber B by the deformation of the lip 12 of the bleed ring 1. However, this air now circulates between the lip 12 of the bleed ring 1 and the first sleeve 85 of the piston 8, instead of the first skirt 84 of the piston 8. The general operation is identical to that described with reference to FIGS. 5*a* to 9*b*.

With respect to the aforementioned description, the optimal dimensional relations for the parts of the invention, including the size, materials, shape, function and operating, assembly and user mode variations, are considered to be apparent and clear to persons skilled in the art, and any relations equivalent to those shown in the drawings and to that which is described in the description are considered to be included in the present invention.

I claim:

1. Air purge device for an airless liquid product dispenser comprising a container equipped with a pump, said air purge device comprising a bleed ring that comprises a deformable lip seal accommodated inside a protective part, designed to be inserted into the container, the lip seal being accommodated inside the protective part before the protective part is inserted into the container and pressing against an internal wall of the protective part, the deformation of the lip when mounting the air purge device in the container causing the air to be purged from the container.

2. Air purge device according to claim 1, wherein the bleed ring is provided with retention and wedging means cooperating with the protective part.

3. Air purge device according to claim 1, wherein the bleed ring comprises a cap annularly extended by said lip seal.

4. Air purge device according claim 3, wherein said lip seal connects to the edge of the cap via a concave portion and presses against an internal wall of the protective part, by buttressing.

5. Air purge device according to claim 4, wherein said protective part is made up of a disc provided with a central opening, from which a central sleeve extends, and a peripheral skirt seal connected to the external edge of the disc, the peripheral lip seal of the bleed ring coming to bear against the wall of the central sleeve or against the wall of said peripheral skirt seal of the protective part.

6. Air purge device according to claim 1, wherein the protective part comprises a neck belonging to a dispensing head of the product dispenser.

7. Air purge device according to claim 1, wherein the protective part comprises a piston belonging to the product dispenser.

8. Dispensing head for an airless liquid product dispenser, comprising a pump and an air purge device, said air purge device comprising a bleed ring that comprises a deformable lip seal accommodated inside a protective part, designed to be inserted into a container, the deformation of the lip when mounting the air purge device in the container causing the air to be purged from the container, the lip seal being accommodated inside the protective part before the protective part is inserted into the container and pressing against an internal wall of the protective part, the protective part comprising a neck having a central sleeve, the neck clipped onto the pump, said bleed ring comprising an axial socket inserted and wedged into the central sleeve of the neck.

9. Airless liquid product dispenser comprising the container and the dispensing head according to claim 8, the lip of the bleed ring being elastically deformed by overpressure when assembling the dispensing head on the container.

10. Plugging device for an airless liquid product dispenser comprising a container equipped with a pump, said device comprising a base part forming the base of the dispenser and being equipped with an air purge device, said air purge device comprising a bleed ring that comprises a deformable lip seal accommodated inside a protective part, designed to be inserted into the container, the lip seal being accommodated inside the protective part before the protective part is inserted into the container, the deformation of the lip when mounting the air purge device in the container causing the air to be purged from the container, the protective part comprising a piston mounted on the base part.

11. Plugging device according to claim 10, wherein the air purge device is translationally movable relative to the base part between an initial extended position, from the moment it is packaged and until the plugging device is installed in the dispenser, and a final retracted position before the product is dispensed, the transition from the extended position to the retracted position causing the air to be purged from the dispenser by the deformation of the lip of the bleed ring.

12. Plugging device according to the claim 11, wherein said retention and wedging means of the bleed ring comprises an axial socket inserted and wedged into the central sleeve of the piston, the ring being movable relative to the piston between an initial extended position, in which the axial socket projects outwards from the base part, and a final retracted position, in which the axial socket is located inside the base part, the transition from the extended position to the retracted position causing the air to be purged from the dispenser by the deformation of the lip of the bleed ring.

13. Plugging device according to claim 10, wherein the piston comprises a disc, a first central sleeve extending from an upper face of the disc and cooperating with the bleed ring, and a second central sleeve extending from a lower face of the disc towards the base of the container and being designed to be introduced into a central opening provided in the base part to this end.

14. Plugging device according to claim 13, wherein the ring is fixed relative to the piston, the piston being movable between an initial extended position, in which the second central sleeve projects outwards from the base part, and a final retracted position, in which the second central sleeve is located inside the base part, the transition from the extended position to the retracted position causing the air to be purged from the dispenser by the deformation of the lip of the bleed ring.

15. Airless liquid product dispenser comprising the container equipped with the pump and the plugging device according to claim 10.

* * * * *